US008093194B2

(12) United States Patent
Chapman et al.

(10) Patent No.: US 8,093,194 B2
(45) Date of Patent: Jan. 10, 2012

(54) ENVIRONMENTALLY ACCEPTABLE ACIDIC LAVATORY TREATMENT COMPOSITIONS

(75) Inventors: Ross Chapman, Montvale, NJ (US); Angelina Lorraine Kulbick, Montvale, NJ (US)

(73) Assignee: Reckitt Benckiser Inc., Parsippany, NJ (US)

( * ) Notice: Subject to any disclaimer, the term of this patent is extended or adjusted under 35 U.S.C. 154(b) by 0 days.

(21) Appl. No.: 12/672,780

(22) PCT Filed: Aug. 4, 2008

(86) PCT No.: PCT/GB2008/002623

§ 371 (c)(1),
(2), (4) Date: Apr. 20, 2010

(87) PCT Pub. No.: WO2009/024743

PCT Pub. Date: Feb. 26, 2009

(65) Prior Publication Data

US 2011/0028369 A1 Feb. 3, 2011
US 2011/0269659 A2 Nov. 3, 2011

Related U.S. Application Data

(60) Provisional application No. 60/956,475, filed on Aug. 17, 2007, provisional application No. 61/083,623, filed on Jul. 25, 2008.

(51) Int. Cl.
*C11D 17/00* (2006.01)

(52) U.S. Cl. ..... 510/191; 510/192; 510/463; 510/470; 510/473

(58) Field of Classification Search ..... None
See application file for complete search history.

(56) References Cited

U.S. PATENT DOCUMENTS

| | | | | |
|---|---|---|---|---|
| 6,336,977 | B1 | 1/2002 | Menke et al. | |
| 6,683,035 | B1 | 1/2004 | Koester et al. | |
| 2002/0187918 | A1 * | 12/2002 | Urban | 510/505 |
| 2004/0186037 | A1 | 9/2004 | Cheung et al. | |

FOREIGN PATENT DOCUMENTS

| | | | |
|---|---|---|---|
| DE | 19918182 | A1 | 10/2000 |
| DE | 10012492 | A1 | 9/2001 |
| WO | 03031550 | A | 4/2003 |

OTHER PUBLICATIONS

English Language Abstract for DE10012492 taken from esp@cenet.com.
English Language Abstract for DE19918182 taken from esp@cenet.com.

* cited by examiner

*Primary Examiner* — Necholus Ogden, Jr.
(74) *Attorney, Agent, or Firm* — Norris McLaughlin & Marcus, PA

(57) ABSTRACT

Aqueous, thickened, acidic compositions which exhibit a pH of about 7 or less preferably 5 or less, and comprise an organic acid constituent selected from formic acid, citric acid and oxalic acid, a thickening constituent or constituents based on one or more gums, particularly xanthan gum which form a thickener system in the inventive composition, and at least one detersive surfactant based on glycoside surfactants, water in an amount of at least 85% wt., preferably at least about 90% wt., and one or more further optional constituents, wherein the compositions exclude: (a) surfactant compounds which include a nitrogen atom in the surfactant compound, and (b) inorganic acids.

20 Claims, No Drawings

ENVIRONMENTALLY ACCEPTABLE ACIDIC LAVATORY TREATMENT COMPOSITIONS

This is an application filed under 35 USC 371 of PCT/GB2008/002623.

The present invention relates generally to hard surface cleaning compositions useful in cleaning, and optionally a disinfecting or sanitizing benefit to hard surfaces. More particularly the present invention relates to hard surface cleaning compositions useful in cleaning, and optionally a disinfecting or sanitizing benefit which are particularly adapted to clean lavatory appliances, particularly toilets and the like.

While the art is replete with hard surface cleaning compositions which are effective in the cleaning of a variety of stains which are frequently encountered in lavatories and bathrooms, e.g., limescale stains, soap scum stains and organic soils, the effective cleaning of lavatory appliances, e.g., toilets, requires that a significant amount of chemical compositions be necessarily present in order to effectively treat the varied stains encountered on such lavatory surfaces. Such is particularly true concerning the surfaces of various lavatory appliances, e.g., toilets, urinals and bidets wherein effective cleaning is desired in view of the standpoint of cleanliness, odor control and sanitation.

To date the most effective cleaning compositions for the treatment of such surfaces typically required one or more chemicals which while effective in treating such hard surfaces are however typically viewed as being environmentally undesirable as featuring one or more of the following characteristics: (i) is considered as being environmentally undesirable as the chemical is a volatile organic compound ("VOC"); (ii) is considered as being environmentally undesirable as the chemical does not degrade or decompose following use when flushed down sewers, drains, septic tanks or into sewage treatment facilities; (iii) is considered as being environmentally undesirable as the chemical poses an unacceptable degree of risk to aquatic life, both plant and/or animal aquatic life. Current and future environmental concerns has spurred legislation or regulations of various countries, regions or other governmental authorities to curtail or deny the use of certain such chemicals, which has reduced the degree of selection of useful chemical raw materials to a chemical formulator. However in spite of such concerns, legislation or regulations there remains a real an continuing need to meet or exceed consumer expectations in providing technically effective hard surface cleaning compositions useful in cleaning, and optionally a disinfecting or sanitizing benefit to hard surfaces and at the same time such formulations need to be considered environmentally acceptable.

It is to this and further needs that the present invention is directed.

According to a first aspect of the invention there is provided a thickened aqueous environmentally acceptable hard surface cleaning compositions useful in cleaning, and optionally a disinfecting or sanitizing benefit to hard surfaces, preferably which are particularly adapted to clean lavatory appliances which compositions comprise (preferably consist essentially of): an organic acid constituent selected from formic acid, citric acid and oxalic acid, a polysaccharide based thickening constituent or constituents preferably those based on one or more gums, particularly xanthan gum which form a thickener system in the inventive composition, and at least one detersive surfactant based on glycoside surfactants, water in an amount of at least 70% wt., preferably at least about 80% wt., and one or more further optional constituents, with the proviso that the compositions exclude one or more of: (a) organic acids, (b) inorganic acids, (c) organic solvents selected from glycols, glycol ethers, ether acetates, and alcohols, (d) thickeners other than polysaccharide based thickeners, and (e) chelating agents based on nitrogen containing organic compounds which include a plurality of carboxylic acid groups. In particularly preferred embodiments the compositions of the invention expressly exclude two or more, preferably three or more and yet more preferably exclude four or five of (a), (b), (c), (d) and (e) denoted immediately above.

According to a second aspect of the invention there is provided a process for the cleaning treatment, and optionally disinfecting or sanitizing treatment of hard surfaces, particularly lavatory hard surfaces which process contemplates the application to such a hard surface in need of a cleaning treatment a cleaning effective amount of the foregoing composition.

According to a still further aspect of the invention there is provided a method for the manufacture of an environmentally acceptable hard surface cleaning compositions useful in cleaning, and optionally a disinfecting or sanitizing benefit to hard surfaces, preferably which are particularly adapted to clean lavatory appliances which compositions are as described in this patent specification.

According to a yet further aspect of the invention there is provided as a packaged ready-to-use type product, a package containing an environmentally acceptable hard surface cleaning compositions useful in cleaning, and optionally a disinfecting or sanitizing benefit to hard surfaces, preferably which are particularly adapted to clean lavatory appliances which compositions are as described in this patent specification.

These and other aspects or objects of the invention are disclosed in the following specification.

The compositions of the invention are largely aqueous, thickened, acidic compositions which exhibit a pH of about 7 or less preferably 5 or less, and comprise an organic acid constituent selected from formic acid, citric acid and oxalic acid, a thickening constituent or constituents based on one or more gums, particularly xanthan gum which form a thickener system in the inventive composition, and at least one detersive surfactant based on glycoside surfactants, water in an amount of at least 70% wt., preferably at least about 80% wt., and one or more further optional constituents, wherein the compositions exclude: (a) surfactant compounds which include a nitrogen atom in the surfactant compound, (b) inorganic acids, (d) thickeners other than polysaccharide based thickeners, and particular other than those based on gums, and (e) chelating agents based on nitrogen containing organic compounds which include a plurality of carboxylic acid groups.

The compositions of the invention include an organic acid constituent which consists of one or more acids selected from formic acid, citric acid and oxalic acid. Of these acids, citric acid is particularly preferred for use as the sole acid present of the organic acid constituent, but of lesser preference mixtures comprising citric acid with oxalic acid, or citric acid with formic acid may also be used as the organic acid constituent. However, it is observed that compositions of the invention which comprise citric acid as the sole organic acid are most advantageous in the treatment of limescale stains or deposits on lavatory appliances.

The organic acid constituent is desirably present in an amount sufficient to provide a pH of about 7 or less, preferably 5 or less to the composition. Advantageously the compositions of the invention exhibit a pH of 4 or less, and increasingly preferably in the order of the following sequence, have a pH of 3.8, 3.5, 3.25, 3.0, 2.75, 2.5, 2.25, and 2. Further advantageously the composition of the invention exhibit a pH of at least 1, and in order of increasing preference exhibit a pH of at least 1.1, 1.2, 1.3, 1.4, 1.5, 1.6, 1.7, 1.75, 1.8, 1.9, 2, 2.1, 2.2, and 2.25.

The organic acid may be present in any effective amount in order to attain a desired acidic pH, advantageously they are present in an amount of from about 0.001-15% wt., and more preferably from 0.001-10% wt., and yet more preferably from about 0.5-8% wt. based on the total weight of the compositions of which they form a part.

In certain preferred embodiments the inventive compositions comprise at least 2% wt., and in order of increasing preference at least 2.2, 2.4, 2.5, 2.6, 2.8, 3, 3.2, 3.4, 3.5, 3.6, 3.8, 4, 4.2, 4.4, 4.5, 4.6, 4.8, 5, 5.2, 5.25, 5.4, 5.5, 5.6, 5.8, 6, 6.2, 6.4, 6.5, 6.6, 6.8 and 7% wt. of the organic acid constituent, particularly wherein the organic acid constituent comprises citric acid, and especially particularly when the organic acid constituent consists solely of citric acid.

The compositions of the invention expressly exclude inorganic acids, including sulfuric acid, phosphoric acid, potassium dihydrogenphosphate, sodium dihydrogenphosphate, sodium sulfite, potassium sulfite, sodium pyrosulfite (sodium metabisulfite), potassium pyrosulfite (potassium metabisulfite), acid sodium hexametaphosphate, acid potassium hexametaphosphate, acid sodium pyrophosphate, acid potassium pyrophosphate, hydrochloric acid, and sulfamic acid. Other water dispersible or water soluble inorganic or mineral acids not specifically eludicated herein are also to be expressly excluded from the inventive compositions.

The compositions of the invention further necessarily include one or more surfactants based on glycosides. Such surfactants include those based on alkylmonoglyocosides and alkylpolyglycosides and include known nonionic surfactants which are alkaline and electrolyte stable. Alkylmonoglycosides and alkylpolyglycosides are prepared generally by reacting a monosaccharide, or a compound hydrolyzable to a monosaccharide with an alcohol such as a fatty alcohol in an acid medium. Various glycoside and polyglycoside compounds including alkoxylated glycosides and processes for making them are disclosed in U.S. Pat. Nos. 2,974,134; 3,219,656; 3,598,865; 3,640,998; 3,707,535, 3,772,269; 3,839,318; 3,974,138; 4,223,129 and 4,528,106 the contents of which are incorporated by reference.

One exemplary group of such useful alkylpolyglycosides include those according to the formula:

$$R_2O—(C_nH_{2n}O)_r—(Z)_x$$

wherein:

$R_2$ is a hydrophobic group selected from alkyl groups, alkylphenyl groups, hydroxyalkylphenyl groups as well as mixtures thereof, wherein the alkyl groups may be straight chained or branched, and which contain from about 8 to about 18 carbon atoms, n has a value of 2-8, especially a value of 2 or 3;

r is an integer from 0 to 10, but is preferably 0,

Z is derived from glucose; and, x is a value from about 1 to 8, preferably from about 1.5 to 5. Preferably the alkylpolyglycosides are nonionic fatty alkylpolyglucosides which contain a straight chain or branched chain $C_8$-$C_{15}$ alkyl group, and have an average of from about 1 to 5 glucose units per fatty alkylpolyglucoside molecule. More preferably, the nonionic fatty alkylpolyglucosides which contain straight chain or branched $C_8$-$C_{15}$ alkyl group, and have an average of from about 1 to about 2 glucose units per fatty alkylpolyglucoside molecule.

A further exemplary group of alkyl glycoside surfactants suitable for use in the practice of this invention may be presented by the following formula (A):

$$RO—(R_1O)_y-(G)_x-Z_b \quad (A)$$

wherein:

R is a monovalent organic radical containing from about 6 to about 30, preferably from about 8 to 18 carbon atoms, $R_1$ is a divalent hydrocarbon radical containing from about 2 to about 4 carbon atoms, y is a number which has an average value from about 0 to about 1 and is preferably 0, G is a moiety derived from a reducing saccharide containing 5 or 6 carbon atoms; and, x is a number having an average value from about 1 to 5 (preferably from 1.1 to 2);

Z is $O_2M^1$,

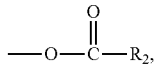

$O(CH_2)$, $CO_2M^1$, $OSO_3M^1$, or $O(CH_2)SO_3M^1$;

$R_2$ is $(CH_2)CO_2M^1$ or $CH{=}CHCO_2M^1$; (with the proviso that Z can be $O_2M^1$ only if Z is in place of a primary hydroxyl group in which the primary hydroxyl-bearing carbon atom, $—CH_2OH$, is oxidized to form a

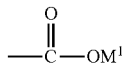

group)

b is a number of from 0 to 3x+1 preferably an average of from 0.5 to 2 per glycosal group;

p is 1 to 10, $M^1$ is $H^+$ or an organic or inorganic counterion, particularly cations such as, for example, an alkali metal cation, ammonium cation, monoethanolamine cation or calcium cation. As defined in Formula (A) above, R is generally the residue of a fatty alcohol having from about 8 to 30 and preferably 8 to 18 carbon atoms. Examples of such alkylglycosides as described above include, for example APG 325 CS Glycoside® which is described as being a 50% $C_9$-$C_{11}$ alkyl polyglycoside, also commonly referred to as D-glucopyranoside, (commercially available from Henkel KGaA) and Glucopon® 625 CS which is described as being a 50% $C_{10}$-$C_{16}$ alkyl polyglycoside, also commonly referred to as a D-glucopyranoside, (ex. Henkel).

Particularly preferred surfactants based on glycosides include those according to the following structure:

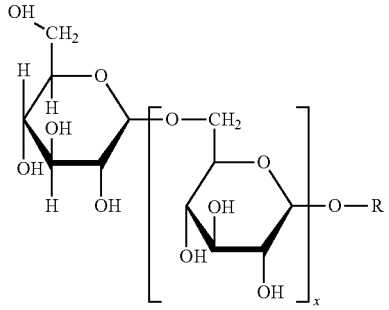

wherein:

R is an alkyl group, preferably a linear alkyl chain, which comprises $C_8$ to $C_{16}$ alkyl groups;

x is an integer value of from 0-3, inclusive.

Examples of such alkylpolyglycoside compounds according to the aforesaid structure include: where R is comprised substantially of $C_8$ and $C_{10}$ alkyl chains yielding an average value of about 9.1 alkyl groups per molecule (GLUCOPON 220 UP, GLUCOPON 225 DK); where R is comprised of $C_8$, $C_{10}$, $C_{12}$, $C_{14}$ and $C_{16}$ alkyl chains yielding an average value of about 10.3 alkyl groups per molecule (GLUCOPON 425N); where R is comprised substantially of $C_{12}$, $C_{14}$ and $C_{16}$ alkyl chains yielding an average value of about 12.8 alkyl groups per molecule (GLUCOPON 600 UP, GLUCOPON 625 CSUP, and GLUCOPON 625 FE, all of which are available from Cognis). Also useful as the alkylpolyglycoside compound is TRITON CG-110 (Union Carbide Corp. subsidiary of Dow Chemical). Further examples of commercially available alkylglycosides as described above include, for example, GLUCOPON 325N which is described as being a 50% $C_9$-$C_{11}$ alkyl polyglycoside, also commonly referred to as D-glucopyranoside (from Cognis). Particularly preferred as the surfactants based on glycosidescompounds are those illustrated in the Examples.

The surfactants based on glycosides are advantageously present in an amount of from about 0.001-15% wt., and more preferably from 0.001-10% wt. based on the total weight of the compositions of which they form a part.

In certain particularly preferred embodiments the one or more surfactants based on glycosides are the sole surfactants present in the compositions of the invention.

The compositions of the invention include a polysaccharide based thickener constituent based, preferably based on one or more gums. More particularly according to the present invention, the polysaccharide serving as the thickener is advantageously selected from among the natural gums, modified natural gums and biosynthetic gums. The term "polysaccharide" is intended to cover all polysaccharides or derivatives thereof which swell upon dispersion in water to produce gels or highly viscous solutions. Exemplary of the natural or modified natural gums are guar gum, carob gum, carragheenates, alginates such as sodium alginate and propyleneglycol alginate, cellulose derivatives, such as the carboxymethylcelluloses, hydroxyalkylcelluloses, and hexamethylpropylcelluloses. Biosynthetic gums or biogums are polysaccharides or heteropolysaccharides of high molecular weight obtained by the fermentation of a carbohydrate under the action of an appropriate microorganism. These microorganisms include bacteria, such as those described in Bergey's, Manual Of Determinative Bacteriology (8th Edition, 1974—Williams and Wilkins Co., Baltimore), for example, bacteria belonging to the genus *Xanthomonas* and more specifically the species *Xanthomonas begoniae, Xanthomonas campestris, Xanthomonas carotae, Xanthomonas hedera, Xanthomonas incanae, Xanthomonas malvacearum, Xanthomonas papaveri* cola, *Xanthomonas phaseolii, Xanthomonas pisi, Xanthomonas vasculorum, Xanthomonas vericatoria, Xanthomonas vitians, Xanthomonas pelargonii*; bacteria of the genus *Arthrobacter* and more particularly the species *Arthrobacter stabilis* and *Arthorobacter viscosus*; of the genus *Erwinia*; of the gums *Azotobacter* and more particularly the species *Azotobacter indicus*; of the genus *Agrobacterium* and more particularly the species *Agrobacterium radiobacter, Agrobacterium rhizogenes* and *Agrobacterium tumefaciens*; or the fungi belonging to the genus *Sclerotium* and more particularly the species *Sclerotium glucanicum, Sclerotium Rolfsii*, and the like.

All of the aforementioned gums display pseudoplastic behavior in aqueous solution.

The heteropolysaccharide designated xanthan gum is preferably selected; the designation "xanthan gum" includes treated and modified materials, such as deacetylized xanthan gum, depyruvatized xanthan gum, xanthan gum cross-linked with polyvalent cations, the gum/glyoxal complexes, and the like. In the compositions of the invention, one gum or a mixture of gums is advantageously present may be used.

The polysaccharide based thickener constituent is advantageously present in an amount of from about 0.001-10% wt., and more preferably from 0.001-5% wt. based on the total weight of the compositions of which they form a part.

Alternately the polysaccharide based thickener constituent is advantageously present in an amount sufficient such that the final viscosity of the inventive compositions is from about 10-1000, preferably from 50-600, and more preferably from about 100-500 when measured according to known techniques, for example using a Brookfield Type III viscometer, #2 spindle, 60 rpm at room temperature (25° C.).

Preferably the polysaccharide based thickener constituent is the sole thickener constituent present in the inventive compositions. Especially preferably the polysaccharide based thickener is based on one or more gums, and yet more preferably consists of xanthan gum.

In particularly preferred embodiments the compositions of the invention expressly exclude further thickeners based on polyacrylates and polyacrylamides, such as those commercially sold under the Carbopol® tradename as well as Acrysol® ICS-1.

In further particularly preferred embodiments the compositions of the invention expressly exclude further thickeners based on clay thickeners for example, colloid-forming clays, for example, such as smectite and/or attapulgite types of thickeners.

In certain particularly preferred embodiments the compositions of the invention expressly exclude (e) chelating agents based on nitrogen containing organic compounds which include a plurality of carboxylic acid groups. Such include, e.g., ethylenediamine mono-, di- or tri-acetic acid, ethylenediaminetetraacetic acid, N-hydroxyethylethylenediamine triacetic acid, nitrilotriacetic acid, diethylene triamine pentaacetic acid, and their water soluble salts of these compounds, especially the alkali metal salts and particularly the sodium salts.

As is noted above, the compositions according to the invention are largely aqueous in nature. Water is added to order to provide to 100% by weight of the compositions of the invention, and desirably comprises at least 70% water, and in order of increasing preference contains 71, 72, 73, 74, 75, 76, 77, 78, 79, 80, 81, 82, 83, 84, 85, 86, 87, 88, 89, 90, 91, 92, 93, 94 and 95 percent water. Concurrently the compositions of the invention comprise, in order of increasing preference, not more than 88, 89, 90, 91, 92, 93, 94, 95, 96, 97 percent water. The water may be tap water, but is preferably distilled and is most preferably deionized water. If the water is tap water, it is preferably substantially free of any undesirable impurities such as organics or inorganics, especially minerals salts which are present in hard water which may thus undesirably interfere with the operation of the constituents present in the compositions.

In addition to the above recited essential constituents, the highly aqueous environmentally acceptable hard surface cleaning compositions of the invention may include one or more further optional constituents in effective amounts. Such further constituents which are directed to improving the aesthetic or functional features of the inventive compositions. By way of non-limiting example, such further constituents include: organic solvents, one or more coloring agents, fragrances and fragrance solubilizers, pH adjusting agents and pH buffers including organic and inorganic salts, one or more further organic acids as co-acids, one or more further surfactants as co-surfactants, optical brighteners, opacifying agents, hydrotropes, preservatives, and anti-corrosion agents. When one or more of the optional constituents is added, i.e., fragrance and/or coloring agents, the esthetic and consumer appeal of the product is often favorably improved. The use and selection of these optional constituents is well known to those of ordinary skill in the art. When present, the total amount of the one or more optional constituents present in the inventive compositions do not exceed about 20% wt., preferably do not exceed 15% wt.

In certain embodiments it is contemplated that in addition to the organic acid selected from formic acid, citric acid and oxalic acid recited above, the compositions of the invention may optionally include one or more further organic acids as co-acids. Exemplary useful organic acids include any known art organic acid which may be found effective in the inventive compositions. Generally useful organic acids are those which include at least one carbon atom, and include at least one carboxyl group (—COOH) in its structure. Preferred are water soluble organic acids which contain from 1 to about 6 carbon atoms, and at least one carboxyl group as noted and exemplary useful organic acids include: linear aliphatic acids such as acetic acid, propionic acid, butyric acid and valeric acid; dicarboxylic acids such as malonic acid, succinic acid, glutaric acid, adipic acid, pimelic acid, fumaric acid and maleic acid; acidic amino acids such as glutamic acid and aspartic acid; and hydroxy acids such as glycolic acid, lactic acid, hydroxyacrylic acid, alpha-hydroxybutyric acid, glyceric acid, tartronic acid, malic acid, and tartaric acid as well as acid salts of these organic acids. When included, such further optional organic acids may be advantageously present in an amount of from about 0.001-15% wt., and more preferably from 0.001-10% wt. based on the total weight of the compositions of which they form a part. However in certain preferred embodiments of the invention, such co-acids are expressly excluded from the compositions of the invention.

In certain embodiments it is contemplated that in addition to the one or more surfactants based on glycosides there may be present one or more co-surfactants based on one or more anionic, nonionic, cationic, zwitterionic or amphoteric surfactants which may be present in any effective amount with the proviso that surfactant compounds which include a nitrogen atom in the surfactant compound are expressly excluded from the compositions of the invention. By way of non-limiting examples such include quaternary ammonium compounds such as dialkyl dimethyl quaternary ammonium salts such as are known to provide a germicidal benefit, sarcosinates, as well as amine oxides.

When present, the co-surfactant advantageously includes one or more nonionic surfactants.

As nonionic surfactants come into consideration generally any nonionic surfactant compound or material.

One class of useful nonionic surfactants include polyalkylene oxide condensates of alkyl phenols. These compounds include the condensation products of alkyl phenols having an alkyl group containing from about 6 to 12 carbon atoms in either a straight chain or branched chain configuration with an alkylene oxide, especially an ethylene oxide, the ethylene oxide being present in an amount equal to 5 to 25 moles of ethylene oxide per mole of alkyl phenol. The alkyl substituent in such compounds can be derived, for example, from polymerized propylene, diisobutylene and the like. Examples of compounds of this type include nonyl phenol condensed with about 9.5 moles of ethylene oxide per mole of nonyl phenol; dodecylphenol condensed with about 12 moles of ethylene oxide per mole of phenol; dinonyl phenol condensed with about 15 moles of ethylene oxide per mole of phenol and diisooctyl phenol condensed with about 15 moles of ethylene oxide per mole of phenol.

A further class of useful nonionic surfactants include the condensation products of aliphatic alcohols with from about 1 to about 60 moles of an alkylene oxide, especially an ethylene oxide. The alkyl chain of the aliphatic alcohol can either be straight or branched, primary or secondary, and generally contains from about 8 to about 22 carbon atoms. Examples of such ethoxylated alcohols include the condensation product of myristyl alcohol condensed with about 10 moles of ethylene oxide per mole of alcohol and the condensation product of about 9 moles of ethylene oxide with coconut alcohol (a mixture of fatty alcohols with alkyl chains varying in length from about 10 to 14 carbon atoms). Other examples are those $C_6$-$C_{11}$ straight-chain alcohols which are ethoxylated with from about 3 to about 6 moles of ethylene oxide. Their derivation is well known in the art. Examples include Alfonic® 810-4.5, which is described in product literature from Sasol as a C8-10 having an average molecular weight of 356, an ethylene oxide content of about 4.85 moles (about 60 wt. %), and an HLB of about 12; Alfonic® 810-2, which is described in product literature as a $C_8$-$C_{10}$ having an average molecular weight of 242, an ethylene oxide content of about 2.1 moles (about 40 wt. %), and an HLB of about 12; and Alfonic® 610-3.5, which is described in product literature as having an average molecular weight of 276, an ethylene oxide content of about 3.1 moles (about 50 wt. %), and an HLB of 10. Other examples of alcohol ethoxylates are C10 oxo-alcohol ethoxylates available from BASF under the Lutensol® ON tradename. They are available in grades containing from about 3 to about 11 moles of ethylene oxide (available under the names Lutensol® ON 30; Lutensol® ON 50; Lutensol® ON 60; Lutensol® ON 65; Lutensol® ON 66; Lutensol® ON 70; Lutensol® ON 80; and Lutensol® ON 110). Other examples of ethoxylated alcohols include the Neodol® 91 series non-ionic surfactants available from Shell Chemical Company which are described as $C_9$-$C_{11}$ ethoxylated alcohols. The Neodol® 91 series non-ionic surfactants of interest include Neodol® 91-2.5, Neodol® 91-6, and Neodol® 91-8. Neodol® 91-2.5 has been described as having about 2.5 ethoxy groups per molecule; Neodol 91-6 has been described as having about 6 ethoxy groups per molecule; and Neodol 91-8 has been described as having about 8 ethoxy groups per molecule. Further examples of ethoxylated alcohols include the Rhodasurf® DA series non-ionic surfactants available from Rhodia which are described to be branched isodecyl alcohol ethoxylates. Rhodasurf® DA-530 has been described as having 4 moles of ethoxylation and an HLB of 10.5; Rhodasurf®DA-630 has been described as having 6 moles of ethoxylation with an HLB of 12.5; and Rhodasurf® DA-639 is a 90% solution of DA-630. Further examples of ethoxylated alcohols include those from Tomah Products (Milton, Wis.) under the Tomadol® tradename with the formula $RO(CH_2CH_2O)_nH$ where R is the primary linear alcohol and n is the total number of moles of ethylene oxide. The ethoxylated alcohol series from Tomah include 91-2.5; 91-6; 91-8—where R is linear $C_9/C_{10}/C_{11}$ and n is 2.5, 6, or 8; 1-3; 1-5; 1-7; 1-73B; 1-9; where R is linear $C_{11}$ and n is 3, 5, 7 or 9; 23-1; 23-3; 23-5; 23-6.5—where R is linear $C_{12}/C_{13}$ and n is 1, 3, 5, or 6.5; 25-3; 25-7; 25-9; 25-12—where R is linear $C_{12}/C_{13}/C_{14}/C_{15}$ and n is 3, 7, 9, or 12; and 45-7; 45-13—where R is linear $C_{14}/C_{15}$ and n is 7 or 13.

A further class of useful nonionic surfactants include primary and secondary linear and branched alcohol ethoxylates, such as those based on $C_6$-$C_{18}$ alcohols which further include an average of from 2 to 80 moles of ethoxylation per mol of alcohol. These examples include the Genapol® UD (ex. Clariant, Muttenz, Switzerland) described under the tradenames Genapol® UD 030, $C_{11}$-oxo-alcohol polyglycol ether with 3 EO; Genapol® UD, 050 $C_{11}$-oxo-alcohol polyglycol ether with 5 EO; Genapol® UD 070, $C_{11}$-oxo-alcohol polyglycol ether with 7 EO; Genapol® UD 080, $C_{11}$-oxo-alcohol polyglycol ether with 8 EO; Genapol® UD 088, $C_{11}$-oxo-alcohol polyglycol ether with 8 EO; and Genapol® UD 110, $C_{11}$-oxo-alcohol polyglycol ether with 11 EO.

A further class of useful nonionic surfactants includethose surfactants having a formula $RO(CH_2CH_2O)_nH$ wherein R is a mixture of linear, even carbon-number hydrocarbon chains ranging from $C_{12}H_{25}$ to $C_{16}H_{33}$ and n represents the number of repeating units and is a number of from about 1 to about 12. Surfactants of this formula are presently marketed under the Genapol® tradename (ex. Clariant), which surfactants include the "26-L" series of the general formula $RO(CH_2CH_2O)_nH$ wherein R is a mixture of linear, even carbon-number hydrocarbon chains ranging from $C_{12}H_{25}$ to $C_{16}H_{33}$ and n represents the number of repeating units and is a number of from 1 to about 12, such as 26-L-1,26-L-1.6, 26-L-2,26-L-3,26-L-5,26-L-45, 26-L-50, 26-L-60, 26-L-60N, 26-L-75, 26-L-80, 26-L-98N, and the 24-L series, derived from synthetic sources and typically contain about 55% $C_{12}$ and 45% $C_{14}$ alcohols, such as 24-L-3,24-L-45, 24-L-50, 24-L-60, 24-L-60N, 24-L-75, 24-L-92, and 24-L-98N, all sold under the Genapol® tradename.

A further class of useful nonionic surfactants include alkoxy block copolymers, and in particular, compounds based on ethoxy/propoxy block copolymers. Polymeric alkylene oxide block copolymers include nonionic surfactants in which the major portion of the molecule is made up of block polymeric $C_2$-$C_4$ alkylene oxides. Such nonionic surfactants, while preferably built up from an alkylene oxide chain starting group, and can have as a starting nucleus almost any active hydrogen containing group including, without limitation, amides, phenols, thiols and secondary alcohols. One group of such useful nonionic surfactants containing the characteristic alkylene oxide blocks are those which may be generally represented by the formula (A):

$$HO\text{-}(EO)_x(PO)_y(EO)_z\text{—}H \quad (A)$$

where

EO represents ethylene oxide,

PO represents propylene oxide, y equals at least 15, $(EO)_{x+y}$ equals 20 to 50% of the total weight of said compounds, and, the total molecular weight is preferably in the range of about 2000 to 15,000. These surfactants are available under the PLURONIC (ex. BASF) or Emulgen (ex. Kao.) A further group of such useful nonionic surfactants containing the characteristic alkylene oxide blocks are those can be represented by the formula (B):

$$R\text{-}(EO,PO)_a(EO,PO)_b\text{—}H \quad (B)$$

wherein R is an alkyl, aryl or aralkyl group, where the R group contains 1 to 20 carbon atoms, the weight percent of EO is within the range of 0 to 45% in one of the blocks a, b, and within the range of 60 to 100% in the other of the blocks a, b, and the total number of moles of combined EO and PO is in the range of 6 to 125 moles, with 1 to 50 moles in the PO rich block and 5 to 100 moles in the EO rich block. Specific nonionic surfactants which in general are encompassed by Formula B include butoxy derivatives of propylene oxide/ethylene oxide block polymers having molecular weights within the range of about 2000-5000.

Still further examples of useful nonionic surfactants include those which can be represented by formula (C) as follows:

$$RO\text{—}(BO)_n(EO)_x\text{—}H \quad (C)$$

wherein

EO represents ethylene oxide,

BO represents butylene oxide,

R is an alkyl group containing Ito 20 carbon atoms, n is about 5-15 and x is about 5-15.

Yet further useful nonionic surfactants include those which may be represented by the following formula (D):

$$HO\text{-}(EO)_x(BO)_n(EO)_y\text{—}H \quad (D)$$

wherein

EO represents ethylene oxide,

BO represents butylene oxide, n is about 5-15, preferably about 15, x is about 5-15, preferably about 15, and y is about 5-15, preferably about 15.

Still further exemplary useful nonionic block copolymer surfactants include ethoxylated derivatives of propoxylated ethylene diamine, which may be represented by the following formula:

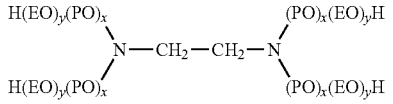

(E)

where (EO) represents ethoxy, (PO) represents propoxy, the amount of $(PO)_x$ is such as to provide a molecular weight prior to ethoxylation of about 300 to 7500, and the amount of $(EO)_y$ is such as to provide about 20% to 90% of the total weight of said compound.

Further useful non-ionic surfactants which may be used in the inventive compositions include those presently marketed under the trade name Pluronics® (ex. BASF). The compounds are formed by condensing ethylene oxide with a hydrophobic base formed by the condensation of propylene oxide with propylene glycol. The molecular weight of the hydrophobic portion of the molecule is of the order of 950 to 4,000 and preferably 200 to 2,500. The addition of polyoxyethylene radicals of the hydrophobic portion tends to increase the solubility of the molecule as a whole so as to make the surfactant water-soluble. The molecular weight of the block polymers varies from 1,000 to 15,000 and the polyethylene oxide content may comprise 20% to 80% by weight. Preferably, these surfactants are in liquid form and particularly satisfactory surfactants are available as those marketed as Pluronics® L62 and Pluronics® L64. Of course the nonionic surfactant constituent, when present, my comprise two or more nonionic surfactants.

When present, any optional co-surfactants are desirably included in an amount of from about 0.001-15% wt., and more preferably from 0.001-10% wt. based on the total weight of the compositions of which they form a part. However in certain preferred embodiments of the invention, such co-surfactants are expressly excluded from the compositions of the invention.

In certain embodiments the compositions of the invention may include one or more organic solvents including glycols, glycol ethers, ether acetates, alcohols and alkanolamine solvents. Exemplary alcohols include $C_3$-$C_8$ alcohols which may be straight chained or branched, and which are specifically intended to include both primary and secondary alcohols. Exemplary glycol ethers include those glycol ethers having the general structure $R_a$—O—$R_b$—OH, wherein $R_a$ is an alkoxy of 1 to 20 carbon atoms, or aryloxy of at least 6 carbon atoms, and $R_b$ is an ether condensate of propylene glycol and/or ethylene glycol having from one to ten glycol monomer units. More specific examples of organic solvents excluded from the inventive compositions include: propylene glycol methyl ether, dipropylene glycol methyl ether, tripropylene glycol methyl ether, propylene glycol n-propyl ether, ethylene glycol n-butyl ether, diethylene glycol n-butyl ether, diethylene glycol methyl ether, propylene glycol, ethylene glycol, isopropanol, ethanol, methanol, diethylene glycol monoethyl ether acetate and particularly advantageously ethylene glycol hexyl ether, diethylene glycol hexyl ether, as well as the $C_3$-$C_8$ primary and secondary alcohols. $C_1$-$C_4$ primary and secondary alcohols are preferred.

Further potentially useful organic solvents which may be included in the compositions of the invention are alkanolamine solvents, including monoalkanolamines, dialkanolamines, trialkanolamines, and alkylalkanolamines such as alkyl-dialkanolamines, and dialkyl-monoalkanolamines, wherein the alkanol and alkyl groups are generally short to medium chain length, that is, from 1 to 7 carbons in length.

When present, any optional organic solvents are desirably included in an amount of from about 0.001-15% wt., and more preferably from 0.001-10% wt. based on the total weight of the compositions of which they form a part. However in certain preferred embodiments of the invention, organic solvents are expressly excluded from the compositions of the invention.

The compositions of the invention optionally but in certain cases desirably include a fragrance constituent. Such fragrances which may be natural or synthetically produced. Fragrance raw materials may be divided into three main groups: (1) the essential oils and products isolated from these oils; (2) products of animal origin; and (3) synthetic chemicals. Generally perfumes are complex mixtures or blends various organic compounds including, but not limited to, certain alcohols, aldehydes, ethers, aromatic compounds and varying amounts of essential oils such as from about 0 to about 85% by weight, usually from about 10 to about 70% by weight, the essential oils themselves being volatile odiferous compounds and also functioning to aid in the dissolution of the other components of the fragrance composition. Fragrance compositions as received from a supplier may be provided as an aqueous or organically solvated composition, and may include as a hydrotrope or emulsifier a surface-active agent, typically a surfactant, in minor amount, generally not in excess of about 1.5% wt. Such fragrance compositions are quite usually proprietary blends of many different specific fragrance compounds. However, one of ordinary skill in the art, by routine experimentation, may easily determine whether such a proprietary fragrance composition is compatible in the compositions of the present invention.

Such fragrances may be added in any conventional manner, admixing to a composition or blending with other constituents used to form a composition, in amounts which are found to be useful to enhance or impart the desired scent characteristic to the composition, and/or to cleaning compositions formed therefrom.

Further optional, but advantageously included constituents are one or more coloring agents which find use in modifying the appearance of the compositions and enhance their appearance from the perspective of a consumer or other end user. Known coloring agents.e.g., pigments and dyes including CI Direct dyes as well as FD&C approved colorants may be incorporated in the compositions in any effective amount to improve or impart to compositions a desired appearance or color. Such a coloring agent or coloring agents may be added in a conventional fashion, i.e., admixing to a composition or blending with other constituents used to form a composition. The inclusion of a coloring agent is frequently desired in that such provides improved visibility of the composition and its presence on a surface being treated. Typically such one or more coloring agents are present in amounts not in excess of about 1.5% wt. yet more preferably are not present in amounts in excess of 1% wt.

The compositions of the invention may include one or more biodegradable chelating agents as well, which may be included in effective amounts.

Preservatives may also be added in minor amounts in the formulations according to the invention. Compositions known in the art including commercially available preparations can be used. Examples of such preservatives compounds include those which are presently commercially available under the trademarks Kathon® CG/ICP (Rohm & Haas, Philadelphia Pa.), Suttocide® A (Sutton Labs, Chatham N.J.) as well as Midtect® TFP (Tri-K Co., Emerson, N.J.). Such preservatives are generally added in only minor amounts, i.e., amounts of about 0.5% by weight of the total composition, more generally an amount of about 0.1% by weight and less, and preferably present in amounts of about 0.05% by weight and less. Typically such preservative constituents are not necessary in the inventive compositions due to their acidic pH.

The compositions of the invention may include one or more pH adjusting agents, or compounds which may be use to adjust the pH of the compositions, or to buffer the pH of the compositions of which they form a part.

The composition provided according to the invention can be desirably provided as a ready to use product in a manually operated spray-dispensing container or in a deformable "squeeze bottle" type dispenser. With regard to the former, such are known to the art and typically comprise a flask or bottle suited for containing a quantity of the liquid composition of the invention which may be dispensed via a manually operated spray pump, while the latter is also known to the art and typically comprises a deformable bottle, typically formed of a synthetic polymer such a polyolefin (e.g., polyethylene, polypropylene, etc.) or a polyalkylene terephthalate from which the liquid composition is expelled, typically via a nozzle, by a user compressing part of the deformable bottle. The latter provides a low cost delivery system and is particularly preferred.

In a yet a further embodiment, the compositions according to the invention may be formulated so that they may be useful in conjunction with an "aerosol" type product wherein they are discharged from a pressurized aerosol container. If the inventive compositions are used in an aerosol type product, it is preferred that corrosion resistant aerosol containers, such as coated or lined aerosol containers be used. Such are preferred as they are known to be resistant to the effects of acidic formulations. Known art propellants, such as liquid propellants as well as propellants of the non-liquid form, i.e., pressurized gases, including carbon dioxide, air, nitrogen, hydrocarbons as well as others may be used.

While the cleaning compositions are most beneficial for use in undiluted form, viz., their form as described above, they may also be diluted to form a cleaning composition therefrom. Such cleaning compositions may be easily prepared by diluting measured amounts of the compositions in further amounts of water by the consumer or other end user in certain weight ratios of composition to water, and optionally, agitating the same to ensure even distribution of the composition in the water. The aqueous compositions according to the invention may be used without further dilution, but may also be used with a further aqueous dilution, i.e., in composition to water concentrations of about 1:0 to extremely dilute dilutions such as about 1:10,000, but preferably would be used in a weight or volume ratio proportion of about 1:10 to about 1:100. Generally better results and faster removal are to be expected at lower relative dilutions of the composition and the water.

The compositions according to the invention are easily produced by any of a number of known art techniques. Conveniently, a part of the water is supplied to a suitable mixing vessel further provided with a stirrer or agitator, and while stirring, the remaining constituents are added to the mixing vessel, including any final amount of water needed to provide to 100% wt. of the inventive composition.

Illustrative example compositions which may be produced include those set forth below. The illustrative example compositions demonstrate certain particularly preferred embodiments of the invention as well as preferred weight percentages as well as preferred relative weight percentages/weight ratios with regard to the respective individual constituents present within a composition.

EXAMPLES

Examples of inventive formulations are shown in the following Table 1; unless otherwise stated, the components indicated are provided as "100% active" unless otherwise stated on Table 1 or Table 2. The amounts of the named constituents are indicated in % w/w based on a total weight of the compositions of which they form a part. Deionized water was added in "quantum sufficient" ("q.s.") to each of first aqueous composition and second aqueous composition so to provide the balance to 100 parts by weight of each. In addition to the constituents identified, the pH of the compositions and the viscosity of the compositions as measured using a Brookfield Type III viscometer, #2 spindle, 60 rpm at room temperature (25° C.).

The compositions on the following Table 1 were produced by providing measured amounts of the individual constituent to a proportion of the water present in each individual component under stirring and at room temperature.

TABLE 1

| | Ex. 1 | Ex. 2 | Ex. 3 | Ex. 4 | Ex. 5 | Ex. 6 | Ex. 7 | Ex. 8 | Ex. 9 | Ex. 10 | Ex. 11 |
|---|---|---|---|---|---|---|---|---|---|---|---|
| glycoside surfactant | 1.27 | 1.27 | 1.27 | 1.27 | 1.27 | 1.27 | 1.27 | 1.27 | 1.27 | 1.27 | 1.27 |
| formic acid | 2 | — | 5 | 7 | 7 | 7 | 7 | — | — | — | — |
| oxalic acid | — | — | — | — | — | — | — | — | — | 1.5 | 2.5 |
| citric acid | — | 5 | — | — | — | — | — | 7.7 | 7.7 | 6.2 | 5.2 |
| xanthan gum | 0.4 | 0.4 | 0.4 | 0.25 | 0.15 | 0.28 | 0.3 | 0.25 | 0.3 | 0.3 | 0.3 |
| water | q.s. | q.s. | q.s. | q.s. | q.s. | q.s. | q.s. | q.s. | q.s. | q.s. | q.s. |
| pH | 2.61 | 2.32 | 2.24 | 2.19 | 2.08 | 2.12 | 2.1 | 2.38 | 2.38 | 1.84 | 1.61 |
| viscosity (cps) | 453 | 485 | 490 | 197 | 85.3 | 170.7 | 229.3 | 106.7 | 256 | 250 | 213 |

| | Ex. 12 | Ex. 13 | Ex. 14 | Ex. 15 | Ex. 16 | Ex. 17 | Ex. 18 | Ex. 19 | Ex. 20 |
|---|---|---|---|---|---|---|---|---|---|
| glycoside surfactant | 0.44 | 0.44 | 0.38 | 0.38 | 0.38 | 0.38 | 0.38 | 0.38 | 1.27 |
| formic acid | — | — | — | — | — | — | — | — | — |
| oxalic acid | 1.5 | 2.5 | — | — | — | — | — | — | — |
| citric acid | 6.2 | 5.2 | 7.7 | 7.7 | 7.7 | 7.7 | 7.7 | 7.7 | 10 |
| xanthan gum | 0.32 | 0.32 | 0.32 | 0.32 | 0.32 | 0.32 | 0.32 | 0.32 | 0.4 |
| KOH | 1.5 | 1.5 | — | — | — | — | — | — | — |
| colorant | — | — | — | 0.003 | — | — | — | 0.003 | — |
| fragrance | — | — | — | — | 0.28 | 0.28 | 0.28 | 0.28 | — |
| water | q.s. | q.s. | q.s. | q.s. | q.s. | q.s. | q.s. | q.s. | q.s. |
| pH | 2.94 | 2.96 | 2.16 | 2.18 | 2.15 | 2.21 | 2.2 | — | 2 |
| viscosity (cps) | 272 | 277 | 192 | 202 | 198 | 217 | 215 | — | 490 |

The identity of the specific constituents are disclosed on the following Table 2.

TABLE 2

| | |
|---|---|
| glycoside surfactant | supplied as Glucopon 425N |
| formic acid | laboratory grade formic acid |
| oxalic acid | laboratory grade oxalic acid |
| citric acid | anhydrous laboratory grade citric acid |
| xanthan gum | laboratory grade xanthan gum |
| KOH | potassium hydroxide, supplied as a pH adjusting agent |
| colorant | proprietary composition of its supplier |
| fragrance | proprietary composition of its supplier |
| water | deionized water |

Several of the compositions disclosed on the foregoing tables were evaluated as to their efficacy in the removal of limescale from hard surfaces according to the following test protocol.

Limescale Removal Evaluation:

The efficacy of certain of the composition disclosed on Table 1 with respect to limescale removal was demonstrated according to the following test protocol: New marble cubes (approx. ¾"×¾" ⅜") were rinsed with copious amounts of de-ionised water and dried for one hour at 105° C. in an oven. The cubes were left to cool and weighed on an analytical balance. 8 ml of a test formulation was added via a syringe or eyedropper to the top of the cubes which were resting in a polymeric or foil balance boat (80 mm×80 mm). The cubes were left for 5 and 10 minutes, and then were thoroughly rinsed clean with de-ionised water. The cubes were then left to dry for one hour in an oven at 105° C. before being left to cool at room temperature. Subsequently the cubes were then reweighed. For each sample formulation tested, five cubes were tested with each sample formulation. The percentage weight loss of the cubes was calculated using the following formula:

% limescale dissolved=100×(initial weight of cuve−final weight of cube)/initial weight of cube The five individual results obtained for each formulation were average and the resulting average of the evaluation are reported on the following Table.

TABLE

Limescale Removal

| | % limescale dissolved |
|---|---|
| Ex. 1 | 0.0163 |
| Ex. 2 | 0.049 |
| Ex. 3 | 0.0665 |
| Ex. 4 | 0.0968 |
| Ex. 5 | 0.1428 |
| Ex. 6 | 0.0915 |
| Ex. 7 | 0.0862 |
| Ex. 8 | 0.0635 |
| Ex. 9 | 0.0643 |
| Ex. 10 | 0.0369 |
| Ex. 11 | 0.0184 |
| Ex. 12 | 0.0325 |
| Ex. 13 | 0.0188 |
| Ex. 14 | 0.0611 |

From the foregoing reported results, the inventive compositions exhibit good limescale removal efficacy.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of the appended claims.

The invention claimed is:

1. A liquid, pourable or sprayable aqueous, thickened hard surface cleaning composition comprising:

an organic acid constituent selected from the group consisting of: formic acid, citric acid and oxalic acid, a polysaccharide based thickening constituent present in an amount of up to about 0.4% wt., and at least one detersive surfactant based on glycoside surfactants present in an amount of up to about 1.27% wt., water in an amount of at least 70% wt., and optionally one or more further optional constituents, with the proviso that the compositions exclude one or more of: (a) organic acids other than formic acid, citric acid and oxalic acid, (b) inorganic acids, (c) organic solvents selected from glycols, glycol ethers, ether acetates, and alcohols, (d) thickeners other than polysaccharide based thickeners, and (e) chelating agents based on nitrogen containing organic compounds which include a plurality of carboxylic acid groups.

2. A composition according claim 1, characterized in that at least two of (a), (b), (c), (d) and (e) are excluded from the composition.

3. A composition according claim 2, characterized in that at least three of (a), (b), (c), (d) and (e) are excluded from the composition.

4. A composition according claim 3, characterized in that at least four of (a), (b), (c), (d) and (e) are excluded from the composition.

5. A liquid, pourable or sprayable, aqueous, thickened hard surface cleaning composition comprising:

an organic acid constituent selected from the group consisting of: formic acid, citric acid and oxalic acid, a polysaccharide based thickening constituent:

and at least one detersive surfactant based on glycoside surfactants;

water in an amount of at least 70% wt., and optionally one or more further optional constituents, with the proviso that the compositions exclude: (a) organic acids other than formic acid, citric acid and oxalic acid, (b) inorganic acids, (c) organic solvents selected from glycols, glycol ethers, ether acetates, and alcohols, (d) thickeners other than polysaccharide based thickeners, and (e) chelating agents based on nitrogen containing organic compounds which include a plurality of carboxylic acid groups.

6. A composition according to claim 1, characterized in that (b) inorganic acids, (c) organic solvents selected from glycols, glycol ethers, ether acetates, and alcohols, (d) thickeners other than polysaccharide based thickeners are excluded from the composition.

7. A composition according to claim 1, characterized in that (b) inorganic acids, (c) organic solvents selected from glycols, glycol ethers, ether acetates, and alcohols, (d) thickeners other than polysaccharide based thickeners, and (e) chelating agents based on nitrogen containing organic compounds which include a plurality of carboxylic acid groups are excluded from the composition.

8. A composition according to claim 1, wherein the composition has a pH of from 1.5 to 3.

9. A composition according to claim 1 which further comprises an aerosol propellant.

10. A composition according to claim 9, wherein the aerosol propellant is selected from liquid propellants and pressurized gases.

11. A composition according to claim 1, wherein the organic acid constituent comprises between 0.5-8% wt. of the composition.

12. A composition according to claim 1, wherein the polysaccharide thickener constituent comprises 0.001-5% wt. of the composition.

13. A composition according to claim 1 wherein the polysaccharide based thickener is xanthan gum.

14. A composition according to claim 1, wherein one or more surfactants based on glycosides are the sole surfactants present in the compositions of the invention.

15. A composition according to claim 5, wherein the composition has a pH of from 1.5 to 3.

16. A composition according to claim 5 which further comprises an aerosol propellant.

17. A composition according to claim 5, wherein the organic acid constituent comprises between 0.5-8% wt. of the composition.

18. A composition according to claim 5, wherein the polysaccharide thickener constituent comprises 0.001-5% wt. of the composition.

19. A composition according to claim 5 wherein the polysaccharide based thickener is xanthan gum.

20. A composition according to claim 5, wherein one or more surfactants based on glycosides are the sole surfactants present in the compositions of the invention.

* * * * *

UNITED STATES PATENT AND TRADEMARK OFFICE

CERTIFICATE OF CORRECTION

PATENT NO. : 8,093,194 B2
APPLICATION NO. : 12/672780
DATED : January 10, 2012
INVENTOR(S) : Ross Chapman et al.

It is certified that error appears in the above-identified patent and that said Letters Patent is hereby corrected as shown below:

On the Title page of the patent "(73) Assignee: Reckitt Benckiser Inc., Parsippany, NJ (US)" should read:

-- (73) Assignee: Reckitt Benckiser LLC, Parsippany, NJ (US) --

Signed and Sealed this
Thirty-first Day of July, 2012

David J. Kappos

David J. Kappos
*Director of the United States Patent and Trademark Office*